US007322624B2

(12) United States Patent
Murphy

(10) Patent No.: US 7,322,624 B2
(45) Date of Patent: Jan. 29, 2008

(54) BAG HOLDER

(75) Inventor: David J. Murphy, Chicago, IL (US)

(73) Assignee: Sierra Housewares, Inc., Chicago, IL (US)

( * ) Notice: Subject to any disclaimer, the term of this patent is extended or adjusted under 35 U.S.C. 154(b) by 0 days.

(21) Appl. No.: 11/083,904

(22) Filed: Mar. 18, 2005

(65) Prior Publication Data

US 2006/0208515 A1 Sep. 21, 2006

(51) Int. Cl.
*B65D 33/06* (2006.01)

(52) U.S. Cl. ..... 294/137; 294/158; 294/165

(58) Field of Classification Search ..... 294/159, 294/137, 158, 165, 166, 171; 24/598.1, 599.1, 24/599.4, 599.9
See application file for complete search history.

(56) References Cited

U.S. PATENT DOCUMENTS

| | | | | |
|---|---|---|---|---|
| 5,441,323 | A * | 8/1995 | Goddard | 294/158 |
| 5,651,575 | A * | 7/1997 | Bystrom et al. | 294/171 |
| D386,682 | S * | 11/1997 | Richardson et al. | D9/434 |
| 5,855,403 | A * | 1/1999 | Harper | 294/158 |
| 5,904,388 | A * | 5/1999 | Seibel | 294/163 |
| 6,347,822 | B1 | 2/2002 | Miller, Jr. | |
| 6,623,056 | B1 | 9/2003 | Wickson | |
| 6,669,254 | B2 * | 12/2003 | Thom et al. | 294/19.1 |
| 7,097,223 | B1 * | 8/2006 | Bradford | 294/137 |
| 2004/0051331 | A1 | 3/2004 | Freedlund | |
| 2004/0112850 | A1 | 6/2004 | Jordan | |
| 2004/0178648 | A1 | 9/2004 | Moses | |
| 2006/0087139 | A1 * | 4/2006 | Ayres | 294/137 |

FOREIGN PATENT DOCUMENTS

FR 2659626 * 9/1991

OTHER PUBLICATIONS

Grabby Plastic Bag Holder, www.onlineorganizing.com/ProductsPage.asp?name=Grabby_Plastic_Bag_Holder Mar. 10, 2005.
Bag Carriers Plain, www.promoblasts.com/bagcarriersplain.htm Mar. 10, 2005.
Grocery Grip Bag Holder, www.lifehome.com/products/7441.asp Mar. 10, 2005.
TOTASAK, www.totasak.com/whatis.htm.

* cited by examiner

*Primary Examiner*—Dean J Kramer
(74) *Attorney, Agent, or Firm*—Vangelis Economou; IPHorgan, Ltd.

(57) ABSTRACT

A bag holder including a main enclosure body for practically enclosing a space shaped and configured to hold bags by their handles, the space being essentially surrounded by the main enclosure body, the main enclosure body having two ends proximate to each other which are separated by a gap and a retractable clip member connected to a first one of the main enclosure body ends and being capable to extend to and engage the second end such that engagement of the clip with the second end completes the enclosure formed by the main enclosure body, wherein the clip member is selectively positioned by the user as to open or close the gap. A method of using the bag is also disclosed.

16 Claims, 2 Drawing Sheets

BAG HOLDER

BACKGROUND OF THE INVENTION

1. Field of the Invention

This invention relates generally to holders, and more specifically to holders for holding plastic shopping bags easily and conveniently.

2. Background Art

Plastic shopping bags have become ubiquitous to the shopping experience. Often, and especially when a shopper is leaving a grocery or department store, the shopper is required to hold a great number of bags, the number being in excess of the number of fingers for holding each bag. Moreover, as the thickness of the plastic shopping bags decreases to effect cost savings to the store, the shopper may experience an unpleasant sensation of the plastic cutting into the fingers as the plastic bag "handle," usually just a hole in the plastic material forming the bag, bunches up and creates a sharp "edge". When holding a number of such bags, the intense pressure on the shopper's fingers may be sharp enough to cut off the circulation of blood therein.

Another difficulty is experienced after the shopper has reached his or her vehicle in the parking lot, and has deposited the shopping bags into the trunk or baggage compartment. Upon arrival at the destination, the shopper must once again gather up the shopping bags by inserting the fingers through each of the bag handle holes, two for each bag, before carrying the bags to the final destination, e.g., the shopper's home. Care must be taken to ensure that each of the two handles, for each bag being transported, is engaged because lifting a bunch of bags when one is not being held, or is being held by one handle hole only, may lead to a bag falling to the ground or being emptied of its contents, and possibly the breaking of containers made of glass or plastic, and thereby requiring cleanup of the contents and broken glass. Thus, a method is needed to retain the bags in a position that would make it easy and convenient to pick them up, while ensuring that all of the bag handles are engaged so as to avoid having a bag slip from the shopper's hold or opening to disgorge its contents.

The prior efforts to address these problems have been by and large unsuccessful in solving these problems in an efficient and effective way. For example, some of these bag holders are open ended holder that provides for carrying bags having handles or other items. However, because the bag holder does not provide a complete enclosure, leaving a gap out of which the bag handles may escape, placing the bags when in the holder on a surface, for example the floor of a vehicle, cannot ensure that all of the bags will remain in engagement when the shopper picks up the bags to transport them from the vehicle.

Other attempts to solve these problems utilize a handle central portion with two hooks on the ends for engaging the bag handles. However, these bag holders have a hook end that returns to the handle, where it is held in place by the shape of the hook. The only impediment to the bag handle becoming loose and slipping out of the hook enclosure is the integrity of the plastic material comprising the holder. Because the clip portion of the plastic holder is thinner at the end which engages the handle portion, it is liable to bend when a force, such as the weight of a bag containing heavy purchases, acts against the closing force of the handle hook. Thus, a shopper would be required to confirm that all bags are engaged by the hook before picking up the handle. Moreover, the shape of this type of handle requires a balanced load on each hook on either side of the handle, otherwise the shopper will be forced to support the handle in an uneven manner.

What has been found lacking and what is disclosed and claimed herein is a bag holder that can provide the benefits of an easy to hold and carry bag holder which has a positive locking mechanism to hold the bags in place at all times, that moreover is easily loaded and unloaded by the shopper; and which retains the bags with the assurance that none of the handles have gone astray.

SUMMARY OF THE INVENTION

Accordingly, what is disclosed and claimed herein is a bag holder comprising a main enclosure body for practically enclosing a space shaped and configured to hold bags by their handles, the space being essentially surrounded by said main enclosure body, said main enclosure body having two ends proximate to each other, said two ends being separated by a gap, a retractable clip member connected to a first one of said main enclosure body ends and being capable to extend to and engage the second end such that engagement of the clip with the second end completes the enclosure formed by the main enclosure body, wherein the clip member is selectively positioned by the user as to open or close the gap. In a method of use, the method of holding bags by their handles comprises the steps of providing an enclosure in a main enclosure body essentially enclosing a central space, and having a gap between two ends thereof, providing a retractable clip that can selectively open and close the gap between the main enclosure body ends, opening the gap by retracting the clip, placing the bag handle into the central space, returning the clip from the retracted position to a closed position in which the enclosure around the central space is secured and lifting the bags by grasping the main enclosure body and lifting.

BRIEF DESCRIPTION OF THE DRAWING FIGURES

Accordingly, the following disclosure is to be considered with reference to the drawing figures in which.

DETAILED DESCRIPTION OF THE PREFERRED EMBODIMENT

Figure 1:
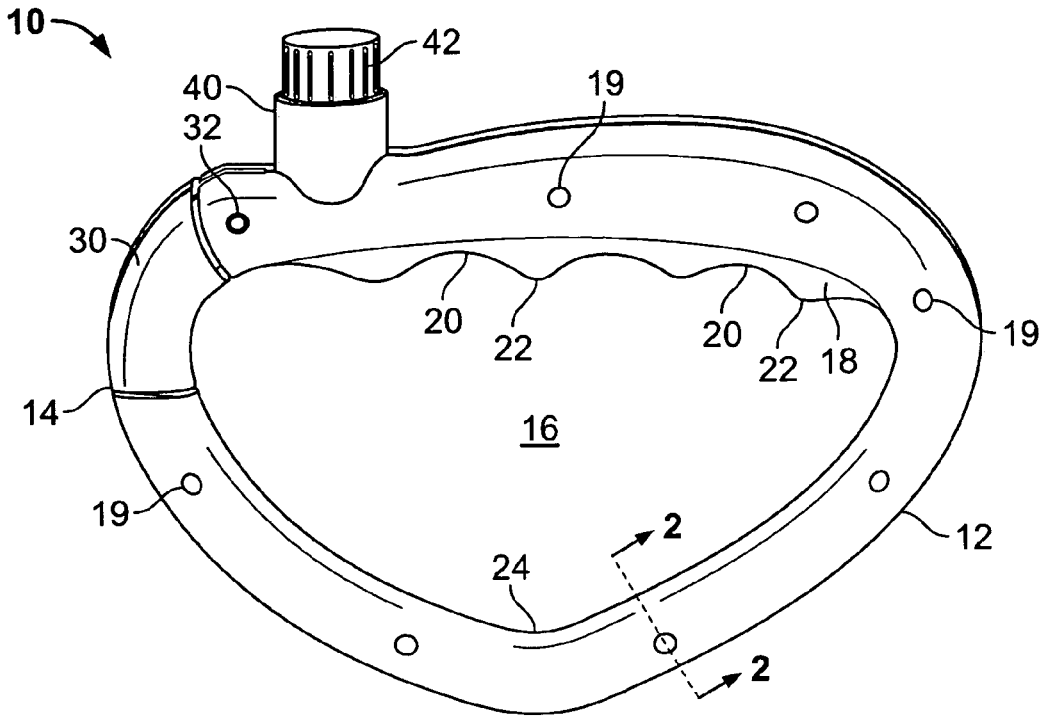
FIG. 1 is an elevational plan view of a bag holder according to the present invention.

A plastic bag holder 10 is shown in FIG. 1 in the closed state, in which the main body portion 12 generally presents an essentially toroidal enclosure having a small section, referred to as an enclosure opening or gap 14, opening to provide access through the enclosure body portion 12 to a central opening 16. The enclosure opening 14 has a retractable spring clip 30, that will be described in greater detail below, that completes the toroidal enclosure at the enclosure opening 14.

The main body portion 12 itself is in the shape of a slightly deformed toroid including a handle section 18, preferably made of a cushioning material to provide comfort in holding when holder 10 is supporting a heavy weight, and an oppositely disposed bag engagement section 24, which is ideally disposed at the horizontal position directly under the middle of the handle section 18. The bag engagement section 18 comprises a rounded trough into which a loosely held bag handle would be naturally guided by the force of gravity acting on the items held in the bag. Thus, the bag engagement point on the main body 12 is inhibited from shifting as the bag and holder are transported.

The handle section 18 is connected to a portion of the main body 12 that is relatively linear, and which together with the handle section 18 provides for a comfortable hold by the user, irrespective of the amount of weight in the bags on the bag holder.

The handle portion preferably comprises a "soft" material, such as thermoplastic elastomer, and is firmly attached to the main body 12 by gluing or other appropriate means. As will be described below, the handle section comprises two halves, a right and a left half, which are joined to each other with the main body portion halves when the bag holder is constructed. The apertures 19 will be used to provide the connection of the two halves. The handle portion 18 includes a molded hand holdable shape, when the two halves thereof have been joined together, to present a plurality of finger grooves 20 separated by ridges 22.

The top portion of the main body 22 includes an outwardly facing orifice 40 adjacent to the portion including clip 30, the orifice having therein a depressible button release 42, which includes an actuation mechanism that is described in greater detail below, to open and close the holder by pivoting the clip 30 about an axle 32 by which the clip 30 is held in place within the holder 10.

The clip 30 is shaped and configured and is held in the closed position so as to close off the enclosure opening 14, and so to present a complete enclosure for retaining the bag handles within the bag holder 10. That is, there is no gap present in the enclosure provided by bag holder 10 through which bag handles may escape due to pulling forces or other phenomena. This is an important feature of the invention that provides the assurance that all bag handles will be retained when the bag holder 10 and bags have been placed on a surface for later pickup as a group.

Figure 2:
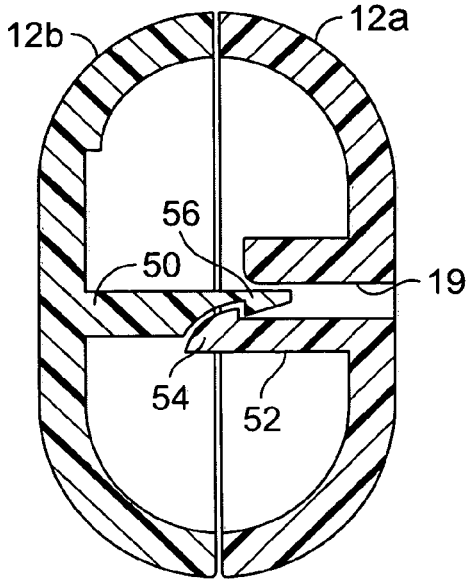
FIG. 2 is a cross-sectional view of a portion of the bag holder body according to the present invention.

Referring now to FIGS. 1 and 2, the connection mechanism for connecting the two halves 12*a* and 12*b* of the bag holder main body 12, the two halves 12*a*,12*b* are essentially identical mirror images of each other except for the means to connect one half to the other. As seen in the cross-sectional view of FIG. 2, one half 12*a*, has an aperture 19 for receiving a prong 50 that is integrally attached to the other half 12*b*. The aperture includes an inwardly extending wall 52 that terminates in an angled detent 54. As can be seen in FIG. 1, there are a plurality of these connections, one each at the apertures 19, which are preferably distributed around the main body 12, so as to retain the two halves to each other and also to retain the other movable elements, for example clip 30 and button release 42, in place within the main body 12.

The other half 12*b* of the main body 12 also includes a corresponding detent 56 on the prong 50, which when the two halves 12*a*,12*b* are snapped together, will cooperate, as shown, to hold the two opposed walls of each half in a connected engagement. Although it may be possible to open the two halves, for example, with a special tool that can bend back the detent 56 and 10 release the engagement of each detent pair 54, 56, it should not be easy for an idle, curious or malicious person to disengage the detents so as to open the main body into its constituent two halves.

Figure 3:
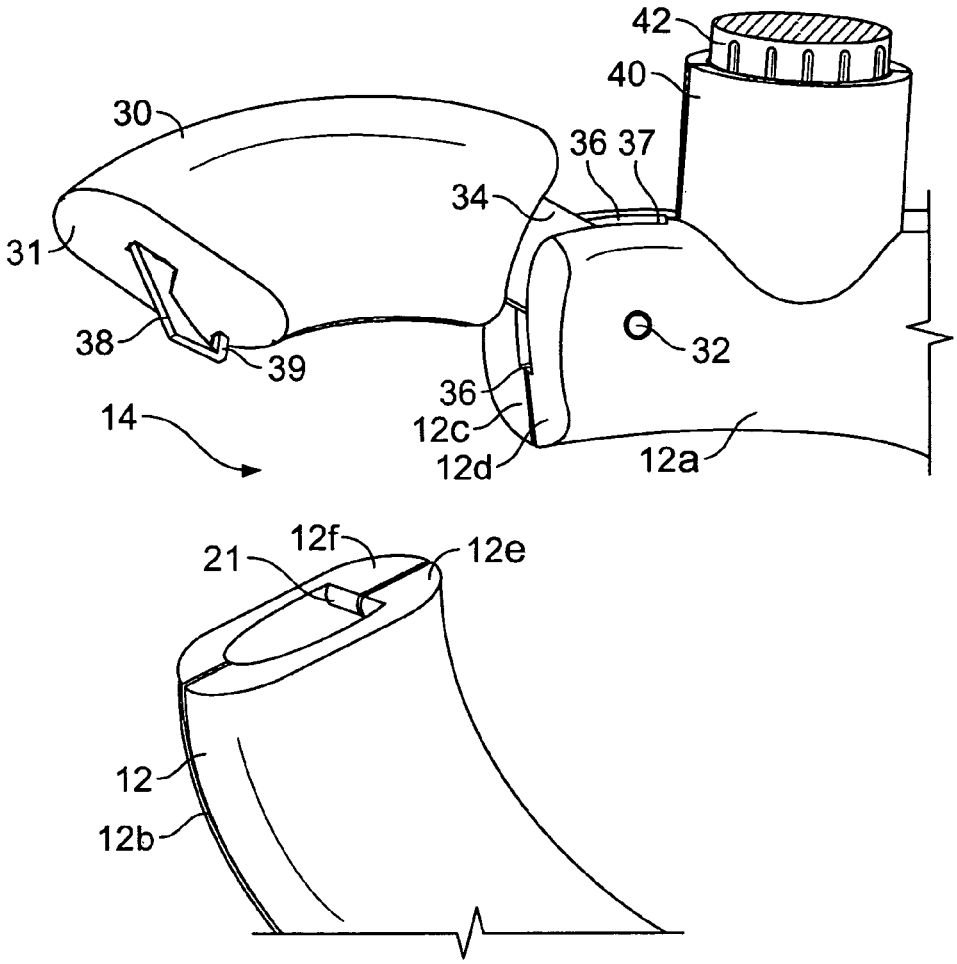
FIG. 3 is a detailed perspective view of the clip portion of the bag holder, shown in the open position ready to receive bags into the central space.

Referring now to FIG. 3, the detail of the clip 30 and the mechanism for operation of the button release 42 will be described. Both the moving parts, that is clip 30 and button release 42, are integral elements, that is, not split into halves such as the two main body halves 12*a*, 12*b*. The clip 30 is pivotable about and axle 32, that may also comprise a detent combination 54,56 of FIG. 2, but more preferably comprises a screw that engages an enclosed inwardly extending screw threaded plastic button (not shown) disposed on the inner wall of the opposite main body half 12*b*. The axle 32 extends through a hole (not shown) in a tab, integrally attached to clip 30, that permits pivoting of the clip 30 thereabout while simultaneously avoiding contact with the end curved walls 12*c*,12*d* of the main body 12. The tab extends into the inner recesses of the main body 12 through a slot 36 that is formed in the end walls 12*c*, 12*d* of the main body 12, but also extends for a short distance along the outer wall portion. Preferably, the outer wall portion of the slot 36 extends to a point 37 directly adjacent the base of orifice 40 where it attaches to the main body 12.

Tab 34 may be a flat portion that provides sufficient structural integrity as to be able to withstand a great amount of pressure from external forces without detaching. A metal pin or, preferably, a screw 32, may also assist in inhibiting the detachment of the tab 34 from the main body 12.

The clip 30 further includes a hook attachment 38, including a detent 39, for attaching the clip 30 to the opposed end of the main body 12. A corresponding protrusion 21, disposed in the inner surface of the opposed end walls 12*e*, 12*f*, provides for a secure connection to the clip 30 as shown in FIG. 1, which connection can only be disengaged by depression of the release button 42.

The release button releasably engages the end of the tab 34 inside of the main body 12 at an extension having a tab portion furthest from the clip 30 and on the opposite side of axle 32. That extension portion (not shown) acts as a lever that upon depression by the release button 42, causes the tab 34 and the clip 30 to pivot about axle 32. Ideally, the initial disengagement of the hook 39 from the protrusion 21 is in the outward direction, and thus clears the protrusion when it is pivoted. Additionally, an appropriate mechanism (not shown) within the release button assembly acts to block the pivot action of clip 30 unless the release button 42 is depressed. The release button assembly includes a spring (not shown) that biases the release button 42 in the position shown in FIG. 1, that is, in the position where the clip 30 is engaged with the other end of the main body 12, and the wall 31 of clip 30 is flush with the end walls 12*e*,12*f*.

The materials utilized for the main body portion 12, the clip 30 and button 42, are hard plastics, such as ABS or Derlin, which retain their integrity. As described above, the handle portion 18 providing for a more comfortable handle to the shopper comprises a different material, such as thermoplastic elastomer or polyurethane rubber. The axle 32 may be metallic, such as steel, and the spring (not shown) may also be made of spring steel, which can retain its elasticity for a great number of uses.

Assembly of the bag holder 10 proceeds in a very simple and straight forward manner. The spring and other movable parts are placed into one main body half, either 12*a* or 12*b*, and the second half is snapped into place by aligning the prongs 50 with apertures 19, going around the complete body 12 to ensure that each of the detent pairs 54, 56 engage each other and lock the main body into a connected unitary piece. Then the screw 34 is inserted into the aperture adjacent the orifice 40 and screwed into the opposing button, completing the assembly procedure. Testing of the operation by depressing the release button 42 provides an assurance of workability of the bag holder 10.

To use the bag holder 10, the shopper brings the bag holder on a shopping expedition, conveniently storing the bag holder in a coat pocket, purse or glove compartment of a vehicle. After proceeding through the checkout counter, the shopper uses the bag holder 10 by depressing the release button 42, thereby opening up the enclosure opening 14 by retracting the clip 30, and placing the bag handles into the enclosure 16 by inserting the open end of the main body 12 through both handles of each bag.

Although the most beneficial use of the bag holder 10 is with the ubiquitous plastic shopping bags, all types of bags, with or without protruding handles, may be held by the bag holder of this invention. In any case, one or more bags, of the same or of different types, may be retained within the enclosure 16, and the shopper then lifts the bags together in one bunch by grasping the handle section 18 and carrying the bags to a vehicle or to the shopper's ultimate destination. If placed on the floor or in the trunk of the vehicle, the bag holder will retain the bags in control of the bag holder, so that when reaching the destination, the shopper need only lift the bag holder 10, which will also pickup all of the bags that were resting on the floor or the trunk, without necessitating to ensure that each bag handle is being held.

Figure 4:
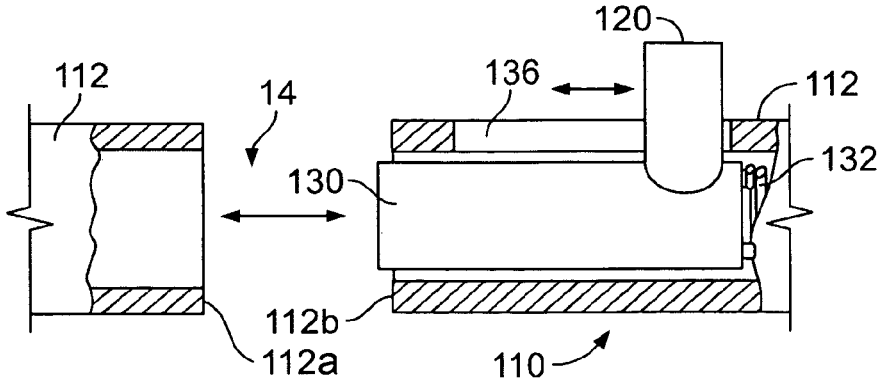
FIG. 4 is a cutaway view of an alternate embodiment of the clip portion of the bag holder, shown in the open position ready to receive bags into the central space.

With reference to FIG. 4, an alternative embodiment of the clip is shown. Rather than a pivotable clip 30 that pivots about an axis 32, described above, the clip 132 can span the gap 14 between the ends 112*a* and 112*b* of the alternative embodiment of the holder 110. An outwardly extending pin 120, which is either connected to or integral with the clip 130, extends through a slot 136 in the outer peripheral wall of the main enclosure body 112.

To open the gap for insertion of bag handles into the gap 14, the shopper merely retracts the pin 120 toward the right through the slot 136, which also slides the clip 130 into the walls defining the body 112. After the bags have been inserted, the shopper releases the pin 120, which is biased in the direction of the arrow by a spring 132 so as to close the gap 14, and thereby enclosing the bag handles within the enclosure of the bag holder 110.

The clip 130 and the pin 120 may comprise metal or hard plastic, or one may be plastic and the other metal. The use of the bag holder 110 follows the steps of that of the holder 10, except instead of a button release, there is a sliding clip release actuated by the shopper in pulling back the pin 132 with a thumb.

This invention is described and illustrated in several preferred embodiments but modification, alterations, substitutions and other changes may be contemplated for those having skill in the art. For example, rather than the attachment combination of the pairs of detents 54, 56, a screw attachment may be utilized at each aperture 19. Although the release mechanism describes a button 42 that is easily depressed by a single hand motion, so as to leave the other hand free to add bags being retained by the holder 10, a lever or pin can be used to retract the clip 30 from the opening 14. Accordingly, the above disclosure and illustration are to be considered exemplary only, and not limiting, the invention being only limited by the following claims and equivalents thereof.

What is claimed is:

1. A bag holder comprising:

a) a main enclosure body for practically enclosing a space shaped and configured to hold bags by their handles, the space being essentially surrounded by said main enclosure body, said main enclosure body having two ends proximate to each other, said two ends being separated by a gap that is upwardly oriented when the bag holder is being used to carry bags; and b) a retractable clip member disposed adjacent the gap and being connected to a first one of said main enclosure body ends by an axle extending in a direction generally transverse to the end where the clip is connected to the main enclosure body, and the clip having an engagement portion being shaped and dimensioned to extend to and engage the second end such that engagement of the clip member with the second end completes the enclosure formed by the main enclosure body, the clip including a tab disposed on the opposite side of the axle from the clip engagement portion; and c) a button assembly, including a button, attached to the main enclosure body and engaging the tab of the retractable clip member, wherein the retractable clip member is selectively positioned by the user by depressing the button thereby engaging the tab of the retractable clip member so as to open or close the gap.

2. The bag holder according to claim 1 further comprising a handle portion positioned along one inner perimeter of the main enclosure.

3. The bag holder according to claim 2 wherein said handle portion is shaped and configured to correspond to the fingers of a user's hand and is formed to fit the fingers in separate finger grooves.

4. The bag holder according to claim 3 wherein the handle portion comprises a different material from the material of the main enclosure body.

5. The bag holder according to claim 4 wherein the main enclosure body further comprises a hard plastic material and the handle portion comprises an elastic material.

6. The bag holder according to claim 5 wherein the handle portion further comprises thermoplastic elastomer.

7. The bag holder according to claim 2 wherein the main enclosure body includes a lowest point in the enclosure that is directly opposite the handle portion when the bag holder is being used to carry bags.

8. The bag holder according to claim 2 wherein the main enclosure body includes a lowest point in the enclosure, when it is being used to carry bags, wherein the lowest point is a feature distally disposed from the gap between the ends of the main enclosure body and that portion of the enclosure containing the lowest point is curved so that the lowest point is furthest from the handle portion.

9. The bag holder according to claim 1 wherein the main enclosure body comprises two separate halves that snap fit to each other to provide for a unitary body.

10. A bag holder comprising:

a) a main enclosure body for practically enclosing a space shaped and configured to hold bags by their handles, the space being essentially surrounded by said main enclosure body, said main enclosure body having a first end and a second end proximate to each other, said two ends being separated by a gap and a handle portion disposed proximate said gap; and b) a retractable clip member connected to a first one of said main enclosure body ends and being capable to extend to and engage the second end such that engagement of the clip member with the second end completes the enclosure formed by the main enclosure body;

wherein the clip member is selectively positioned by the user depressing a button by using the same hand that is holding the main enclosure body so as to open or close the gap, the clip member being pivotable about an axle located proximate the main enclosure body end to which the clip member is connected, the clip member having an engagement portion being shaped and dimensioned to extend to and engage the second end such that engagement of the clip member with the second end completes the enclosure formed by the main enclosure body, the clip including a tab disposed on the opposite side of the axle from the clip engagement portion, the button engaging the tab of the retractable clip member thereby causing the clip member to pivot about the axle when the button is depressed and retracting to a closed position when the button is released.

11. The bag holder according to claim 10 wherein the button is proximate the handle portion.

12. The bag holder according to claim 10 wherein the proximate end of the clip is connected to the first main enclosure body end adjacent the pivot defined by the axle and the distal end of the clip includes a hook member that latches onto a protrusion disposed on the second end of the main enclosure body, whereby the hook securely engages the distal end of the clip to the second end of the main body portion when the button is released by a user.

13. The bag holder according to claim 10 wherein the main enclosure body includes a lowest point in the enclosure that is directly opposite the handle portion when the bag holder is being used to carry bags.

14. The bag holder according to claim 10 wherein the main enclosure body comprises two separate halves that snap fit to each other to provide for a unitary body.

15. A method of holding bags by their handles comprising the steps of:

a) providing an enclosure in a main enclosure body essentially enclosing a central space, and having a gap between two ends thereof;

b) providing a retractable clip, including a tab, that can selectively open and close the gap between the main enclosure body ends, the tab of the retractable clip being engaged by a button assembly including a button;

c) orienting the gap between the two ends so that it faces upwardly;

d) opening the gap by retracting the clip by the user depressing the button and thereby retracting the clip with the same hand that is holding the main enclosure body;

e) placing at least one bag handle into the central space; and f) returning the clip from the retracted position to a closed position in which the enclosure around the central space is secured by releasing the button depressed by the hand holding the enclosure.

16. The method of holding bags according to claim 15 wherein the bags can be lifted by grasping the main enclosure body and lifting by a handle portion.

* * * * *